US006745797B2

(12) United States Patent
Troughton

(10) Patent No.: US 6,745,797 B2
(45) Date of Patent: Jun. 8, 2004

(54) PAPERMAKER'S FORMING FABRIC

(75) Inventor: Brian Herbert Pike Troughton, Herne Bay (GB)

(73) Assignee: Weavexx Corporation, Wake Forest, NC (US)

( * ) Notice: Subject to any disclaimer, the term of this patent is extended or adjusted under 35 U.S.C. 154(b) by 156 days.

(21) Appl. No.: 09/886,819

(22) Filed: Jun. 21, 2001

(65) Prior Publication Data

US 2003/0036327 A1 Feb. 20, 2003

(51) Int. Cl.[7] ..... D03D 11/00

(52) U.S. Cl. ..... 139/383 A; 139/383 AA; 139/408; 139/383 B

(58) Field of Search ..... 139/383 A, 383 AA, 139/408, 383 B

(56) References Cited

U.S. PATENT DOCUMENTS

| | | | |
|---|---|---|---|
| 2,172,430 A | 9/1939 | Barrell | 139/383 |
| 2,554,034 A | 5/1951 | Koester et al. | 139/426 |

(List continued on next page.)

FOREIGN PATENT DOCUMENTS

| | | | |
|---|---|---|---|
| CA | 1115177 | 12/1981 | 139/58 |
| CN | 2-277848 | 4/1998 | D03D/15/00 |
| DE | 454 092 | 12/1927 | |
| DE | 33 29 740 | 3/1985 | D03D/11/00 |
| EP | 0 048 962 | 9/1981 | D03D/1/00 |
| EP | 0 158 710 | 10/1984 | D03D/1/00 |
| EP | 0 185 177 | 10/1985 | D03D/11/00 |
| EP | 0 224 276 | 12/1986 | |
| EP | 0 264 881 | 10/1987 | D21F/1/00 |
| EP | 0 269 070 | 11/1987 | D03D/11/00 |
| EP | 0 284 575 | 2/1988 | D21F/1/00 |
| EP | 0 283 181 | 3/1988 | D21F/1/00 |
| EP | 0 350 673 | 6/1989 | D21F/1/00 |
| EP | 0 048 849 A3 | 5/1990 | |
| EP | 0 048 849 A2 | 5/1990 | D21F/1/00 |
| EP | 0 672 782 | 3/1995 | D21F/1/00 |
| EP | 0 794 283 A1 | 9/1997 | D21F/1/00 |
| FR | 2 597 123 | 4/1986 | D03D/11/00 |

(List continued on next page.)

OTHER PUBLICATIONS

Rule 132 Declaration of Andrew White.

Warren, C.A., "The Importance of Yarn Properties in Wet–End Wire Construction," Seminar, The Theory of Water Removal, Dec. 12, 1979.

International Search Report for PCT Application No. PCT/US97/18627.

International Search Report for PCT Application No. PCT/US97/18629.

Rule 132 Declaration of Robert G. Wilson (Jun. 26, 1997).

*Primary Examiner*—Danny Worrell
*Assistant Examiner*—Robert H. Muromoto, Jr.
(74) *Attorney, Agent, or Firm*—Myers Bigel Sibley & Sajovec

(57) ABSTRACT

A triple layer forming fabric includes: a set of top machine direction yarns; a set of top cross machine direction yarns; a set of bottom machine direction yarns; a set of bottom cross machine direction yarns; and stitching yarns interwoven with the top and bottom fabric layers. A pair of first and second stitching yarns is positioned between adjacent pairs of top cross machine direction yarns. The top machine direction yarns, top cross machine direction yarns, and fiber support portions of the stitching yarns interweave to form a plain weave surface. The top machine direction yarns have a first diameter, the bottom machine direction yarns have a second diameter, and the top cross machine direction yarns have a third diameter. The ratio of the first and second diameters is between about 0.75 and 0.95, and the ratio between the first and third diameters is between about 0.8 and 1.1.

25 Claims, 11 Drawing Sheets

U.S. PATENT DOCUMENTS

| | | | | |
|---|---|---|---|---|
| 3,094,149 | A | 6/1963 | Keily | 139/383 |
| 3,325,909 | A | 6/1967 | Clark | 34/95 |
| 4,093,512 | A | 6/1978 | Fleischer | 162/348 |
| 4,182,381 | A | 1/1980 | Gisbourne | 139/383 A |
| 4,244,543 | A | 1/1981 | Ericson | 248/55 |
| 4,289,173 | A | 9/1981 | Miller | 139/383 A |
| 4,290,209 | A | 9/1981 | Buchanan et al. | 34/123 |
| 4,414,263 | A | 11/1983 | Miller et al. | 428/234 |
| 4,438,788 | A | 3/1984 | Harwood | 139/383 A |
| 4,452,284 | A | 6/1984 | Eckstein et al. | 139/383 A |
| 4,453,573 | A | 6/1984 | Thompson | 139/383 A |
| 4,501,303 | A | 2/1985 | Osterberg | 139/425 A |
| 4,515,853 | A | 5/1985 | Borel | 428/257 |
| 4,529,013 | A | 7/1985 | Miller | 139/383 A |
| 4,564,052 | A | 1/1986 | Borel | 139/425 A |
| 4,592,395 | A | 6/1986 | Borel | 139/383 A |
| 4,592,396 | A | 6/1986 | Borel et al. | 139/425 |
| 4,605,585 | A | 8/1986 | Johansson | 428/224 |
| 4,611,639 | A | 9/1986 | Bugge | 139/383 A |
| 4,621,663 | A | 11/1986 | Malmendier | 139/383 A |
| 4,633,596 | A | 1/1987 | Josef | 34/116 |
| 4,636,426 | A | 1/1987 | Fleischer | 428/224 |
| 4,642,261 | A | 2/1987 | Fearnhead | 428/225 |
| 4,676,278 | A | 6/1987 | Dutt | 139/383 A |
| 4,705,601 | A | 11/1987 | Chiu | 162/348 |
| 4,709,732 | A | 12/1987 | Kinnunen | 139/383 A |
| 4,729,412 | A | 3/1988 | Bugge | 139/383 A |
| 4,731,281 | A | 3/1988 | Fleischer et al. | 428/196 |
| 4,739,803 | A | 4/1988 | Borel | 139/383 A |
| 4,755,420 | A | 7/1988 | Baker et al. | 428/222 |
| 4,759,975 | A | 7/1988 | Sutherland et al. | 428/234 |
| 4,815,499 | A | 3/1989 | Johnson | 139/383 |
| 4,815,503 | A | 3/1989 | Borel | 139/383 A |
| 4,909,284 | A | 3/1990 | Kositzke | |
| RE33,195 | E | 4/1990 | McDonald et al. | 139/425 |
| 4,934,414 | A | 6/1990 | Borel | 139/383 A |
| 4,941,514 | A | 7/1990 | Taipale | 139/383 A |
| 4,942,077 | A | 7/1990 | Wendt et al. | 428/152 |
| 4,945,952 | A | 8/1990 | Vöhringer | 139/383 |
| 4,967,805 | A | 11/1990 | Chiu et al. | 139/383 |
| 4,987,929 | A | 1/1991 | Wilson | 139/383 A |
| 4,989,647 | A | 2/1991 | Marchand | 139/383 A |
| 4,989,648 | A | 2/1991 | Tate et al. | 139/383 |
| 4,998,568 | A | 3/1991 | Vohringer | 139/383 A |
| 4,998,569 | A | 3/1991 | Tate | 139/383 A |
| 5,022,441 | A | 6/1991 | Tate et al. | 139/383 A |
| 5,025,839 | A | 6/1991 | Wright | 139/383 A |
| 5,067,526 | A | 11/1991 | Herring | 139/383 A |
| 5,074,339 | A | 12/1991 | Vohringer | 139/383 A |
| 5,084,326 | A | 1/1992 | Vohringer | 428/194 |
| 5,092,372 | A | 3/1992 | Fitzka et al. | 139/383 A |
| 5,101,866 | A | 4/1992 | Quigley | 139/383 |
| 5,116,478 | A | 5/1992 | Tate et al. | 162/358 |
| 5,152,326 | A | 10/1992 | Vohringer | 139/383 A |
| 5,158,118 | A | 10/1992 | Tate et al. | 139/383 A |
| 5,219,004 | A | 6/1993 | Chiu | 139/383 A |
| 5,228,482 | A | 7/1993 | Fleischer | 139/383 A |
| 5,238,536 | A | 8/1993 | Danby | 162/348 |
| 5,277,967 | A | 1/1994 | Zehle et al. | 139/383 A |
| 5,358,014 | A | 10/1994 | Kovar | 139/383 A |
| 5,421,374 | A | 6/1995 | Wright | 139/383 A |
| 5,421,375 | A | 6/1995 | Praetzel | 139/383 A |
| 5,429,686 | A | 7/1995 | Chiu et al. | 139/383 |
| 5,449,026 | A | 9/1995 | Lee | 139/383 A |
| 5,454,405 | A | 10/1995 | Hawes | 139/383 A |
| 5,456,293 | A | 10/1995 | Ostermayer et al. | 139/383 A |
| 5,465,764 | A | 11/1995 | Eschmann et al. | 139/383 A |
| 5,482,567 | A | 1/1996 | Barreto | 139/383 A |
| 5,487,414 | A | 1/1996 | Kuji et al. | 139/383 |
| 5,518,042 | A | 5/1996 | Wilson | 139/383 A |
| 5,520,225 | A | 5/1996 | Quigley et al. | 139/383 A |
| 5,542,455 | A | 8/1996 | Ostermayer et al. | 139/383 A |
| 5,555,917 | A | 9/1996 | Quigley | 139/383 A |
| 5,564,475 | A | 10/1996 | Wright | 139/383 A |
| 5,641,001 | A | 6/1997 | Wilson | 139/383 A |
| 5,651,394 | A | 7/1997 | Marchand | 139/383 |
| 5,709,250 | A | 1/1998 | Ward et al. | 139/383 A |
| RE35,777 | E | 4/1998 | Givin | 139/383 A |
| 5,746,257 | A | 5/1998 | Fry | 139/383 AA |
| 5,826,627 | A | 10/1998 | Seabrook et al. | 139/383 A |
| 5,857,498 | A | 1/1999 | Barreto et al. | 139/383 |
| 5,881,764 | A | 3/1999 | Ward | 139/383 A |
| 5,937,914 | A | 8/1999 | Wilson | 139/383 A |
| 5,967,195 | A * | 10/1999 | Ward | 139/383 A |
| 5,983,953 | A | 11/1999 | Wilson | 139/383 |
| 6,123,116 | A * | 9/2000 | Ward et al. | 139/383 A |
| 6,145,550 | A | 11/2000 | Ward | 139/383 |
| 6,148,869 | A | 11/2000 | Quigley | 139/383 |
| 6,158,478 | A | 12/2000 | Lee et al. | 139/383 A |
| 6,244,306 | B1 * | 6/2001 | Troughton | 139/383 A |
| 6,253,796 | B1 | 7/2001 | Wilson et al. | 139/383 |

FOREIGN PATENT DOCUMENTS

| | | | |
|---|---|---|---|
| FR | 8605115 | 4/1986 | |
| GB | 2157328 A | 10/1985 | D03D/1/00 |
| GB | 2245006 | 2/1991 | D03D/11/00 |
| JP | 8-158285 | 12/1994 | |
| JP | 9-41282 | 7/1995 | |
| JP | 9-87990 | 9/1995 | |
| WO | WO 86/00099 | 1/1986 | D21F/1/00 |
| WO | WO 89/09848 | 4/1989 | D03D/23/00 |
| WO | WO 93/10304 | 11/1992 | D21F/1/10 |

* cited by examiner

PAPERMAKER'S FORMING FABRIC

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (i.e., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermaker's fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are typically important considerations in papermaking, especially for the forming section of the papermaking machine, where the wet web is initially formed. Wire marking is particularly problematic in the formation of fine paper grades, as it can affect a host of paper properties, such as sheet mark, porosity, "see through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially in terms of skew resistance, narrowing propensity and stiffness), which may negatively impact both the service life and the performance of the fabric.

To combat these problems associated with fine weaves, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, and U.S. Pat. No. 5,437,315 to Ward.

One particularly desirable type of triple layer fabric is illustrated in U.S. Pat. No. 5,967,195 to Ward. The fabrics described therein include pairs of stitching yarns between adjacent top CMD yarns that alternately interweave with the top and bottom MD yarns of the fabric. They do so in such a manner that they "complete the weave" of the weave pattern of the top MD and top CMD yarns. Such a papermaking surface can provide good fiber support, drainage and interlaminar wear resistance. Alternative fabrics of this type are illustrated in U.S. Pat. No. 5,826,627 to Seabrook et al. However, these fabrics can have relatively high caliper, which can have a negative impact on water carry and fiber carry, increasing both of these properties.

The foregoing demonstrates that it would be desirable for a papermaker's forming fabric to have a balance of properties important to papermaking, including relatively low caliper, low void volume for drainage purposes, and good fiber support. It would be particularly desirable for such a forming fabric to have a triple layer structure.

SUMMARY OF THE INVENTION

The present invention, which is directed to a triple layer papermaker's fabric, can provide these desirable characteristics. The triple layer forming fabric includes: a set of top machine direction yarns; a set of top cross machine direction yarns interwoven with the top machine direction yarns to form a top fabric layer; a set of bottom machine direction yarns; a set of bottom cross machine direction yarns interwoven with the bottom machine direction yarns to form a bottom fabric layer; and a plurality of stitching yarns interwoven with the top and bottom fabric layers. A pair of first and second stitching yarns is positioned between adjacent pairs of top cross machine direction yarns; the first and second stitching yarns of each pair are interwoven with the top and bottom machine direction yarns such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first stitching yarn is positioned below the top machine direction yarns. The first and second stitching yarns cross each other as they pass below a transitional top machine direction yarn, and each of the binding portions of the first and second stitching yarns passes below at least one of the bottom machine direction yarns. The top machine direction yarns, top cross machine direction yarns, and fiber support portions of the stitching yarns interweave to form a plain weave surface. The top machine direction yarns have a first diameter, the bottom machine direction yarns have a second diameter, and the top cross machine direction yarns have a third diameter, and a ratio of the first diameter and the second diameter is between about 0.75 and 0.95, and a ratio between the first diameter and the third diameter is between about 0.8 and 1.1. In this configuration, the yarns of the fabric can interweave, and the top and bottom layers of the fabric can intermesh and nest, such that the caliper and the void volume of the triple layer fabric are relatively low, yet the fiber support provided to paper stock is relatively high. As a result, the fabric can provide a desirable combination of properties in a triple layer design.

In certain preferred embodiments, a stitching yarn pair is positioned between each adjacent pair of top cross machine direction yarns. Also, in some embodiments the number of top and bottom cross machine direction yarns are the same, and in other embodiments the number of (a) top cross machine direction yarns and stitching yarn pairs and (b) bottom cross machine direction yarns are the same.

It is also preferred that the diameter of the top machine direction yarns is between about 0.12 and 0.14 mm, the diameter of the bottom machine direction yarns is between about 0.15 and 0.18 mm, and the diameter of the top cross machine direction yarns is between about 0.11 and 0.13 mm.

Objects of the present invention will be appreciated by those of ordinary skill in the art from a reading of the Figures and the detailed description of the preferred embodiments which follow, such description being merely illustrative of the present invention.

BRIEF DESCRIPTION OF THE FIGURES

The accompanying drawings, which are incorporated in and constitute a part of the specification, illustrate embodiments of the invention and, together with the description, serve to explain principles of the invention.

DETAILED DESCRIPTION OF THE INVENTION

Figure 1:
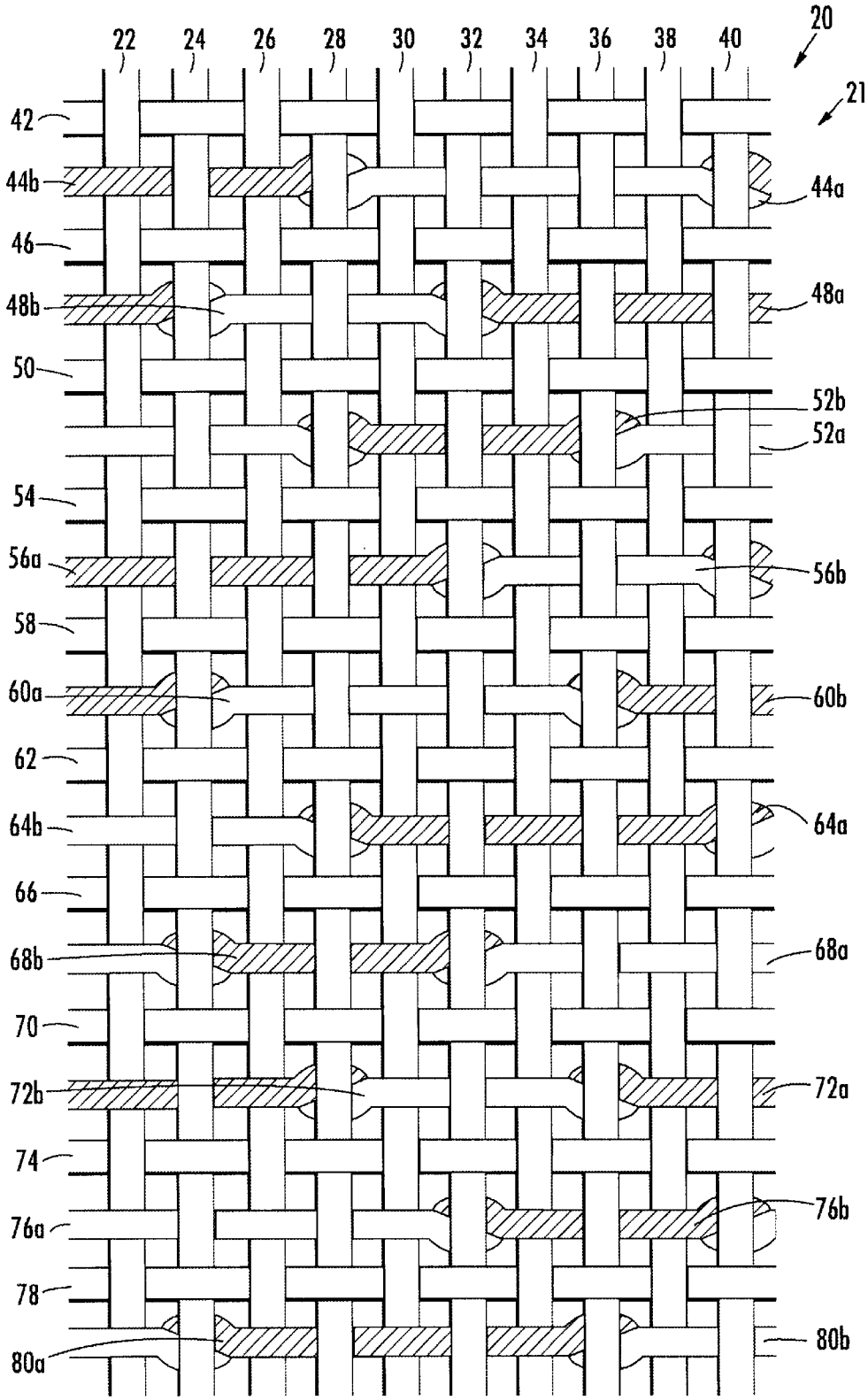
FIG. 1 is a top view of a triple layer papermakers' forming fabric of the present invention.

The present invention will now be described more particularly hereinafter with reference to the accompanying drawings, in which embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some components and layers may be exaggerated for clarity.

As discussed above, triple layer papermakers' forming fabrics of the present invention employ fine top surface yarns as MD yarns, CMD yarns, and stitching yarns. The use of these yarns in some fabric embodiments enables these embodiments to provide desirable properties and/or combinations of properties. For example, some embodiments can provide reduced void volume, which can in turn improve drainage during operation. Other embodiments should have reduced caliper (particularly compared with other triple layer fabrics), which can assist in reducing water and fiber carry, thus improving running efficiency and machine cleanliness. Moreover, the fiber support index ("FSI", as measured by the method developed by Robert L. Beran; see Tappi Journal, April 1979, Vol. 62, No.4 "The Evaluation and Selection of Forming Fabrics", for an explanation of the FSI calculation) of these fabrics can also be increased over other triple layer fabrics. In some preferred embodiments, the combination of reduced void volume and caliper and high fiber support index can make those embodiments extremely desirable, especially in fine paper applications.

In the embodiments employed herein, the top MD yarns will typically be between about 0.12 and 0.14 mm in diameter, the top CMD yarns will be between about 0.11 and 0.13 mm in diameter, and the bottom MD yarns will be between about 0.15 and 0.18 mm in diameter. These yarns can be combined in triple layer fabrics such that the ratio of the diameters of the top and bottom MD yarns (the "top MD/bottom MD ratio") is between about 0.75 and 0.95, and the ratio between the diameters of the top MD yarns and top CMD yarns (the "top MD/top CMD ratio") is between about 0.8 and 1.1. Triple layer fabrics having top MD yarns, bottom MD yarns, and top CMD yarns meeting these ratios can, in some triple layer weave patterns, interweave and intermesh in such a manner that desirable properties or combinations thereof of the type described above are realized. In particular, fabrics utilizing yarns with the ratios set forth above can be produced that have low caliper (on the order of 0.60 mm to 0.75 mm), with a void volume of between about 34 and 42 $mm^3/cm^2$, and an FSI of between about 150 and 200 or more. Preferred top MD/bottom MD ratios are between about 0.75 and 0.90, and more preferably are between about 0.75 and 0.85. Preferred top MD/top CMD ratios are between about 0.90 and 1.10, and more preferably are between about 0.90 and 1.05.

Preferred embodiments of the invention in which these yarn diameter ratios can be employed are set forth below.

Figure 2:
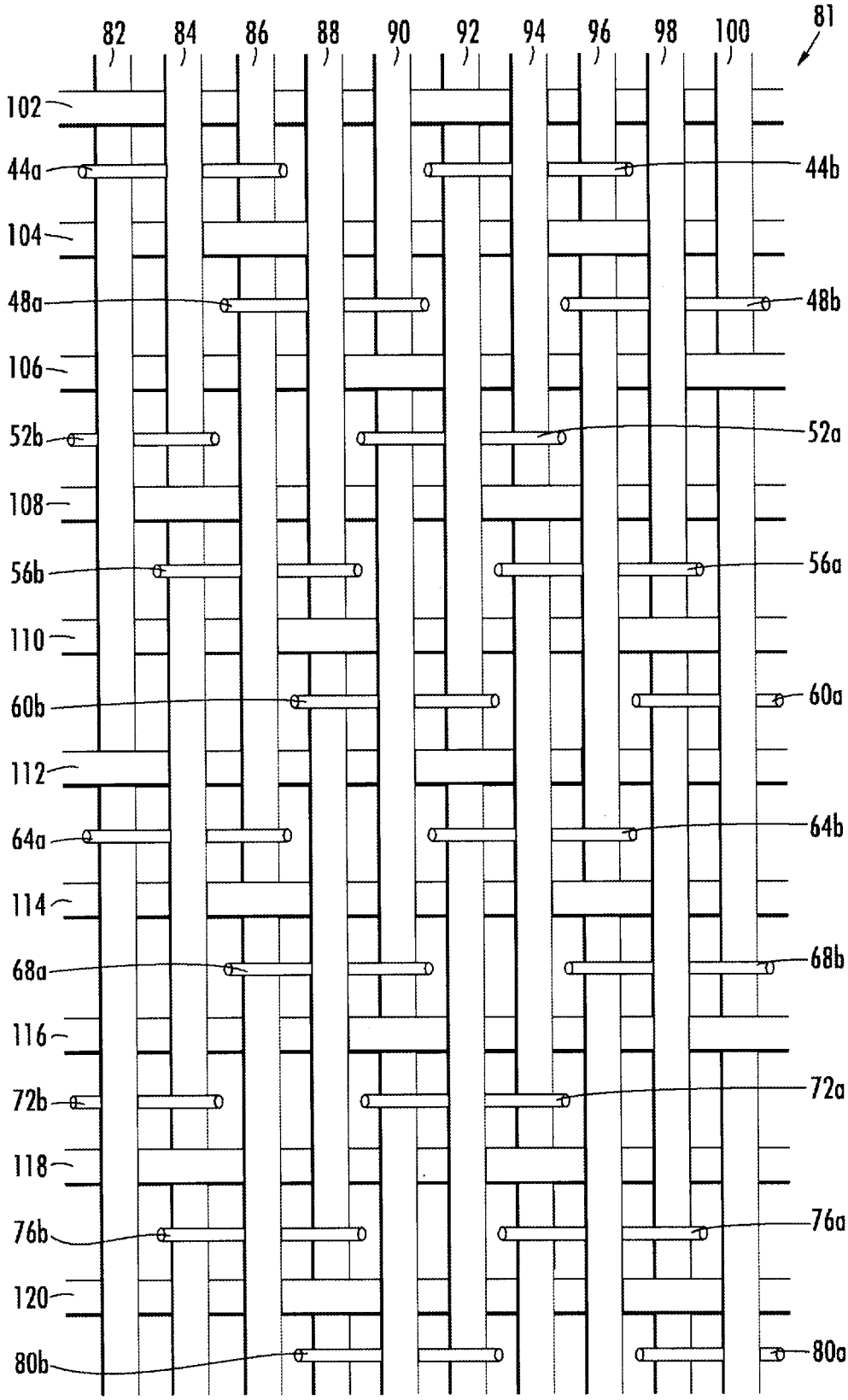
FIG. 2 is a top section view of the bottom layer of the fabric of FIG. 1.

A twenty harness triple layer forming fabric, generally designated at 20, is illustrated in FIGS. 1 and 2, in which a single repeat unit of the fabric 20 is shown. As seen in FIG. 1, the repeat unit of the fabric 20 includes a top layer 21 and a bottom layer 81. The top layer 21 includes ten top MD yarns 22–40 and ten top CMD yarns 42–78. These are interwoven such that each top CMD yarn passes over and beneath top MD yarns in an alternating fashion, with each top CMD yarn passing over and under the same top MD yarns. For example, top CMD yarn 42 passes under top MD yarn 22, over top MD yarn 24, under top MD yarn 26, over top MD yarn 28 and so on until it passes over top MD yarn 40. Similarly, top CMD yarn 46 passes under top MD yarn 22, over top MD yarn 24, under top MD yarn 26, over top MD yarn 28 and so on until it passes over top MD yarn 40.

Still referring to FIG. 1, the top layer 21 also includes portions of twenty stitching yarns, designated herein as pairs 44*a*, 44*b*–80*a*, 80*b*. The stitching yarns are included to bind the top layer 21 and bottom layer 81 together. The stitching yarns are positioned in pairs between adjacent top and bottom CMD yarns; there is no bottom CMD yarn below each stitching yarn pair so that space is present for the stitching yarns to stitch. For example, stitching yarns 44*a* and 44*b* are positioned between top CMD yarns 42 and 46. Fiber support portions of the stitching yarns (described in detail below) interweave with the top MD yarns to form, together with the top CMD yarns, a plain weave pattern in the top layer 21. It should be noted that, when the top and bottom fabric layers 21, 81 are joined, the top CMD yarns are positioned substantially directly above the bottom CMD yarns, such that the aforementioned space exists between adjacent bottom CMD yarns for the stitching yarns.

Referring now to FIG. 2, the repeat unit of the fabric 20 also includes the bottom layer 81. The repeat unit includes ten bottom MD yarns 82–100 which are interwoven with ten bottom CMD yarns 102–120. Each of the bottom MD and CMD yarns is positioned substantially directly below a corresponding top MD or CMD yarn. The bottom MD yarns are interwoven with the bottom CMD yarns in a pattern in which each bottom MD yarn passes over four adjacent bottom CMD yarns, below the next bottom CMD yarn, over the next four adjacent bottom CMD yarns, and below the next bottom CMD yarn. For example, bottom MD yarn 88 passes above bottom CMD yarns 102, 104, 106, 108, below bottom CMD yarn 110, above bottom CMD yarns 112, 114, 116, 118, and below bottom CMD yarn 120. The other bottom MD yarns follow a similar "over 4/under 1/over 4/under 1" weave pattern, but each is offset in its weaving sequence from its nearest bottom MD yarn neighbors by three bottom CMD yarns. Consequently, bottom MD yarn 90 (which is adjacent bottom MD yarn 88) passes above bottom CMD yarns 102, 104, below bottom CMD yarn 106, above bottom CMD yarns 108, 110, 112, 114, above bottom CMD yarn 116, and above bottom CMD yarns 118, 120. Thus, the bottom MD "knuckle" formed by bottom MD yarn 90 as it passes below bottom CMD yarn 116 is offset from the bottom "knuckle" formed by bottom MD yarn 88 as it passes below bottom CMD yarn 110 by three bottom CMD yarns. Also, binding portions of the stitching yarns 44*a*, 44*b*–80*a*, 80*b* (defined in more detail below) are located between each adjacent pair of bottom CMD yarns.

As can be seen in FIGS. 1 and 2, the corresponding pairs of stitching yarns 44*a*, 44*b*–80*a*, 80*b* interweave with the top MD yarns and bottom MD yarns in the following pattern. Each of the stitching yarns of the repeat unit can be subdivided into two portions: a fiber support portion which interweaves with the top MD yarns, and a binding portion which interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. In the illustrated embodiment, the fiber support portion of the stitching yarn of each pair designated with an "a" (e.g., 44*a*, 48*a*, 52*a*) interweaves in an alternating fashion with five top MD yarns (alternately passing over three top MD yarns and under two top MD yarns), and the other stitching yarn of the pair (those designated with a "b") passes over two top MD yarns while passing below a top MD yarn positioned between those two MD yarns. In its fiber support portion, each stitching yarn passes over top MD yarns that the top CMD yarns pass beneath, and passes below top MD yarns that each top CMD yarn passes over. In this manner, the stitching yarns and top CMD form a plain weave pattern with the top MD yarns on the papermaking surface (i.e., the top layer 21) (shown in FIG. 1). In its binding portion, each stitching yarn passes below one bottom MD yarn in the repeat unit such that an "over 4/under 1" pattern is established by the pair of stitching yarns on the bottom layer 81 of the fabric 20 (see FIG. 2). This configuration is discussed in greater detail in U.S. Pat. No. 5,967,195 to Ward, the disclosure of which is hereby incorporated herein by reference in its entirety.

Referring back to FIGS. 1 and 2, pairs of stitching yarns that are positioned adjacent to and on opposite sides of a top or bottom CMD yarn are interwoven with the top or bottom MD yarns such that there is an offset of two MD yarns between such stitching yarn pairs. For example, stitching yarn 44*a* passes above top MD yarns 30, 34 and 38 and below bottom MD yarn 84. The next "a" stitching yarn, stitching yarn 48*a*, passes above top MD yarns 34, 38 and 22 (with top MD yarn 22 being a continuation of the pattern on the opposite side) and below bottom MD yarn 88. Thus, stitching yarn 44*a* is offset from stitching yarn 48*a* by two top and bottom MD yarns. This same two MD yarn offset is followed for the interweaving of the other stitching yarns.

It can also be seen in FIGS. 1 and 2 that the stitching yarns are interwoven with the top and bottom MD yarns as "reversed picks." This concept is described in detail in U.S. Pat. No. 5,967,195 to Ward and need not be discussed further herein. Those skilled in this art will appreciate that, although the illustrated reversed picks configuration is preferred, the present invention may also be employed with non-reversed picks fabrics.

Exemplary yarn sizes for the fabric 20 are set forth in Table 1.

TABLE 1

| Yarn | Diameter (mm) |
|---|---|
| Top MD | 0.13 |
| Top CMD | 0.13 |
| Stitching Yarn | 0.11 |
| Bottom MD | 0.17 |
| Bottom CMD | 0.22 |

With these dimensions, the top MD/bottom MD ratio is 0.764, and the top MD/top CMD ratio is 1.00. The fabric 20 woven with these yarn sizes and ratios has been shown to have a void volume of 42.7 $mm^3/cm^2$, a caliper of 0.69 mm and a fiber support index of 193. Thus, this embodiment can provide an improved combination of void volume, caliper and fiber support when compared to prior triple layer fabrics.

Figure 3:
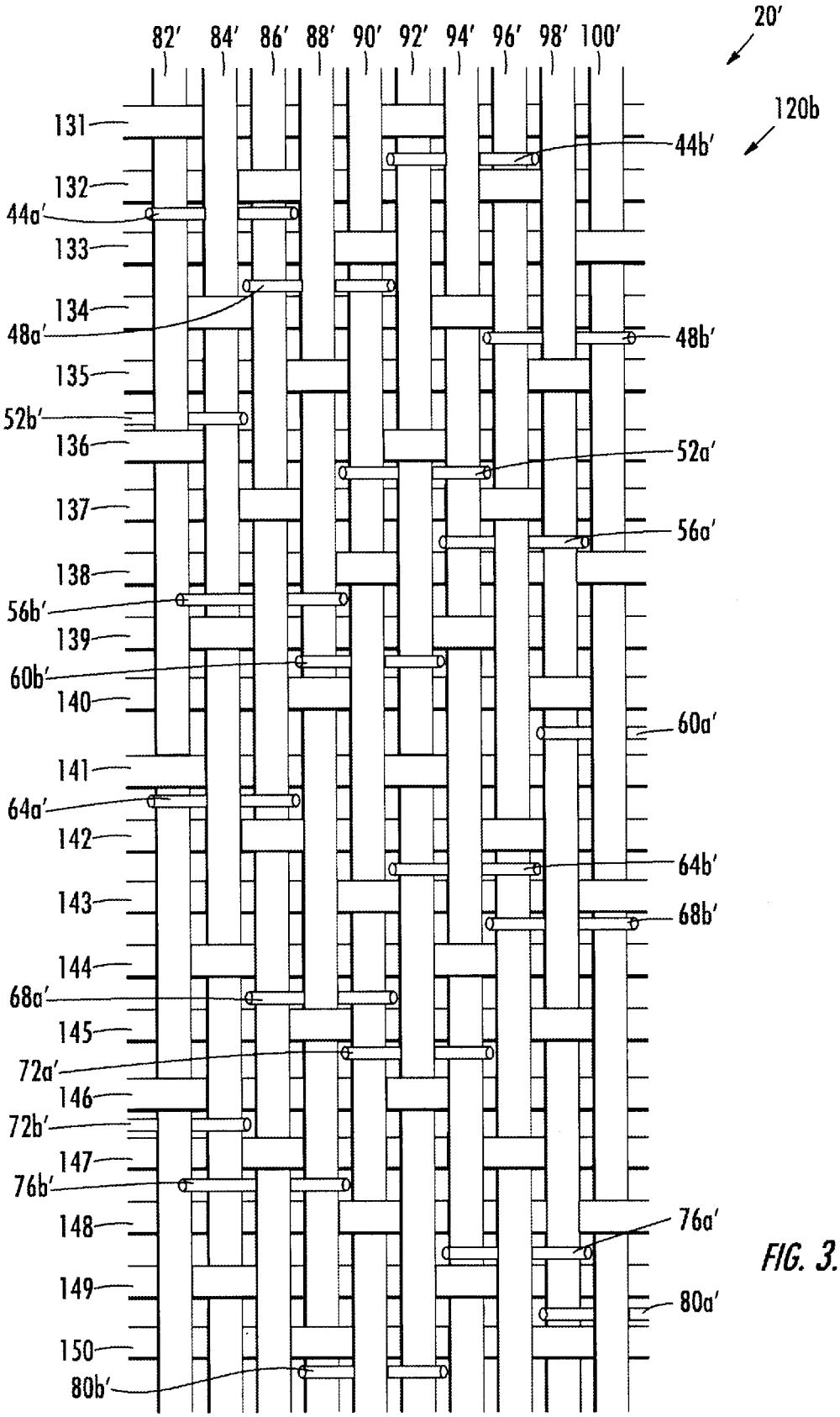
FIG. 3 is a top section view of another embodiment of a triple layer papermakers' forming fabric of the present invention showing the configuration of the bottom layer of the fabric.

Another twenty harness triple layer fabric embodiment of the present invention, designated broadly at 20', is illustrated in FIG. 3. The fabric 20' includes a top layer that is identical in weave pattern to the embodiment illustrated in FIG. 1. The bottom layer 120*b* of the fabric 20' includes ten bottom MD yarns 82'–100' interwoven with twenty bottom CMD yarns 131–150. The fabric 20' also includes ten pairs of stitching yarns 44*a*', 44*b*'–80*a*', 80*b*' that interweave with the top and bottom fabric layers.

The bottom MD yarns 82'–100' interweave with the bottom CMD yarns 131–150 in the same "over 4/under 1" sequence seen in fabric 20 illustrated in FIG. 1; however, in the fabric 20' there are twice as many bottom CMD yarns as are present in the fabric 20, such that a bottom CMD yarn is present below every pair of stitching yarns. In this embodiment, the stitching yarn pairs 44*a*', 44*b*'–80*a*', 80*b*' interweave in the same pattern with the top MD yarns and bottom MD yarns as in the fabric 20; however, in the fabric 20' the stitching yarns of each pair separate from one another as they pass below a bottom MD yarn, with one stitching yarn of the pair passing on one side of the bottom CMD yarn that resides below the pair, and the other stitching yarn passing on the other side of that bottom CMD yarn. For example, the stitching yarn 44*a*' passes below bottom MD yarn 84' while passing on the side of bottom CMD yarn 133 nearest bottom CMD yarn 134. In contrast, the stitching yarn 44*b*'(which is paired with stitching yarn 44*a*') passes below bottom MD yarn 94' while passing on the side of bottom CMD yarn 133 nearest bottom CMD yarn 132. In the manner, the stitching yarns 44*a*', 44*b*' can maintain their positions somewhat centered between the top CMD yarns 42, 46 on the top fabric layer.

Exemplary yarn sizes for the fabric 20' are set forth in Table 2.

TABLE 2

| Yarn | Diameter (mm) |
|---|---|
| Top MD | 0.13 |
| Top CMD | 0.13 |
| Stitching Yarn | 0.11 |
| Bottom MD | 0.17 |
| Bottom CMD | 0.18 |

Figure 4:
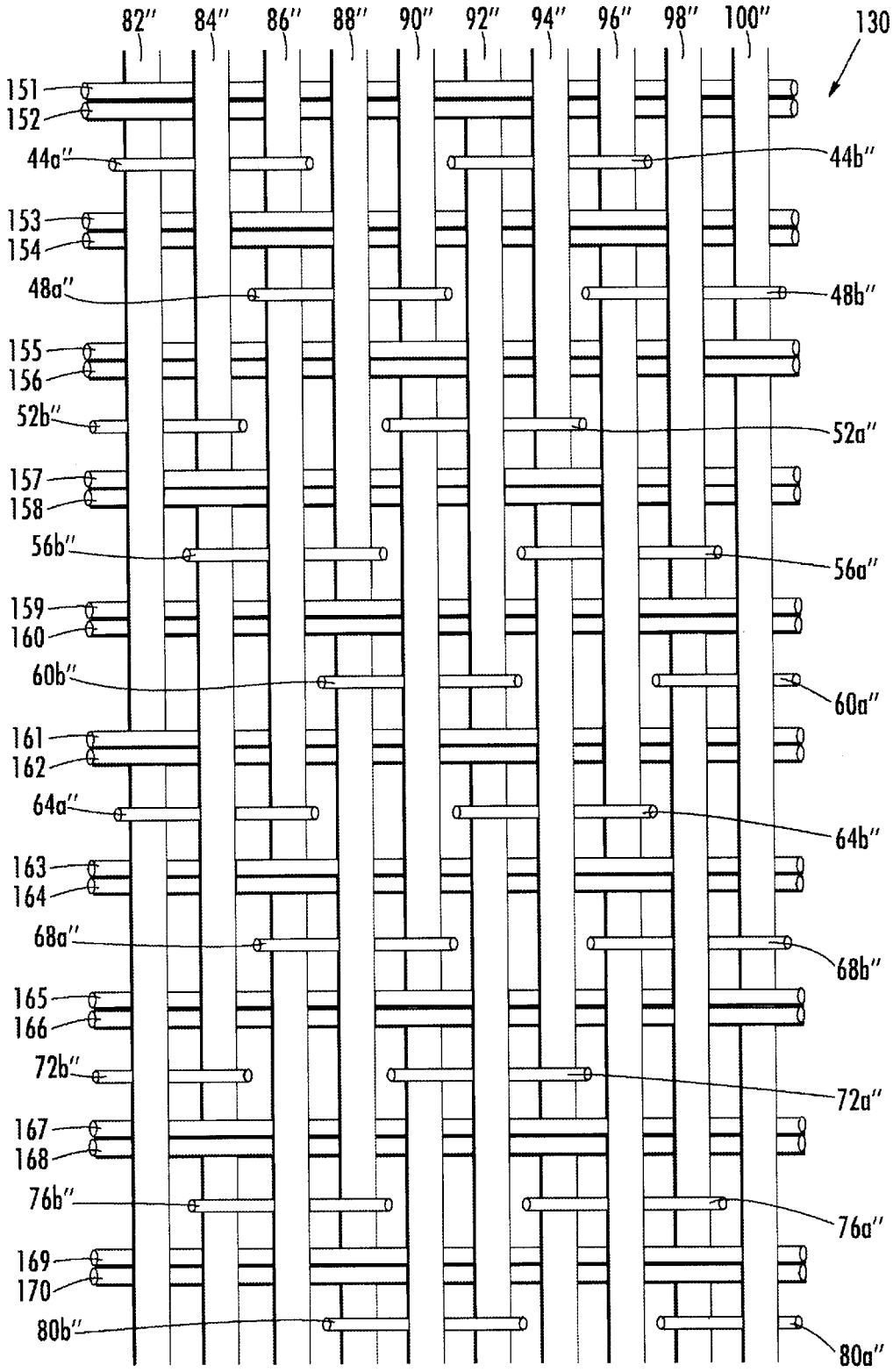
FIG. 4 is a top section view of another embodiment of a triple layer papermakers' forming fabric of the present invention showing the configuration of the bottom layer of the fabric.

Another embodiment of a twenty harness triple layer forming fabric (designated broadly at 130) is illustrated in FIG. 4. The top layer of the fabric 130 is identical to that of the fabric 20 of FIGS. 1 and 2; however, the bottom layer 130*b* differs in that the bottom CMD yarns are paired.

The repeat unit of the bottom fabric layer of the fabric 130 includes a set of bottom MD yarns 82"–100" which are interwoven with a set of bottom layer CMD yarns 151–170. As shown in FIG. 4, the yarns comprising the set of bottom layer CMD yarns 151–170 are interwoven with the set of bottom layer MD yarns 82"–100" in pairs. Each of the yarns comprising a pair are woven together in the same shed of the fabric, and thus the yarns forming each of these paired bottom fabric layer CMD yarns (such as pair 151/152) have an identical weave pattern in the fabric. By "woven in the same shed" it is meant that the yarns are woven adjacent to each other and have an identical weave pattern with respect to the MD yarns with which they weave. Note that herein, unless the context demands otherwise, references to a "paired bottom fabric layer CMD yarn" are intended to refer to a single yarn which is formed from two yarns that are woven in the same shed. Accordingly, a reference to a fabric having paired bottom fabric layer CMD yarns that is woven, for example, in a 1×4 twill pattern, refers to a fabric woven in a 1×4 twill pattern if the paired bottom fabric layer CMD yarns are treated as a single yarn.

In FIG. 4, the bottom layer MD yarns 82"–100" are interwoven with the pairs of yarns that comprise the set of bottom layer CMD yarns 151–170 in a 1×4 twill type pattern, meaning that each of the yarn pairs 151/152–169/170 passes above one bottom MD yarn, below the next four bottom MD yarns, above the next bottom MD yarn, and below the next four bottom MD yarns. For example, bottom CMD yarn pair 151/152 passes above bottom MD yarn 82", below bottom MD yarns 84"–90", above bottom MD yarn 92", and below bottom MD yarns 94"–100". The other paired bottom fabric layer CMD yarns follow a similar "over-one/under-four" weave pattern, although this pattern is offset by two bottom layer MD yarns for adjacent paired bottom layer CMD yarns. Thus, for example, paired bottom fabric layer CMD yarn 153/154 passes above bottom MD yarns 86" and 96", whereas adjacent paired bottom fabric layer CMD yarn 135/136 passes above bottom MD yarns 90" and 100".

The top fabric layer (pictured in FIG. 1) and the bottom fabric layer 130*b* (pictured in FIG. 4) are stitched together with ten stitching yarn pairs 44*a*", 44*b*'–80*a*", 80*b*'. These stitching yarns are positioned in pairs between adjacent yarns of the set of top layer CMD yarns 22–40. For example, stitching yarn pair 44*a*", 44*b*" is positioned between top CMD yarns 42 and 46 and between paired bottom fabric layer CMD yarns 151/152 and 153/154. As with the fabric of FIGS. 1 and 2, the stitching yarns interweave with the top MD yarns and bottom MD yarns to bind the top fabric layer 21' and the bottom fabric layer 30' together. The stitching yarns 44*a*", 44*b*"–80*a*", 80*b*" are woven in a reversed picks configuration, but this embodiment may be woven also in a non-reversed picks configuration.

Exemplary yarn sizes for the fabric 130 are set forth in Table 3.

TABLE 3

| Yarn | Diameter (mm) |
|---|---|
| Top MD | 0.13 |
| Top CMD | 0.13 |
| Stitching Yarn | 0.11 |
| Bottom MD | 0.17 |
| Bottom CMD | 0.18 |

Figure 5:
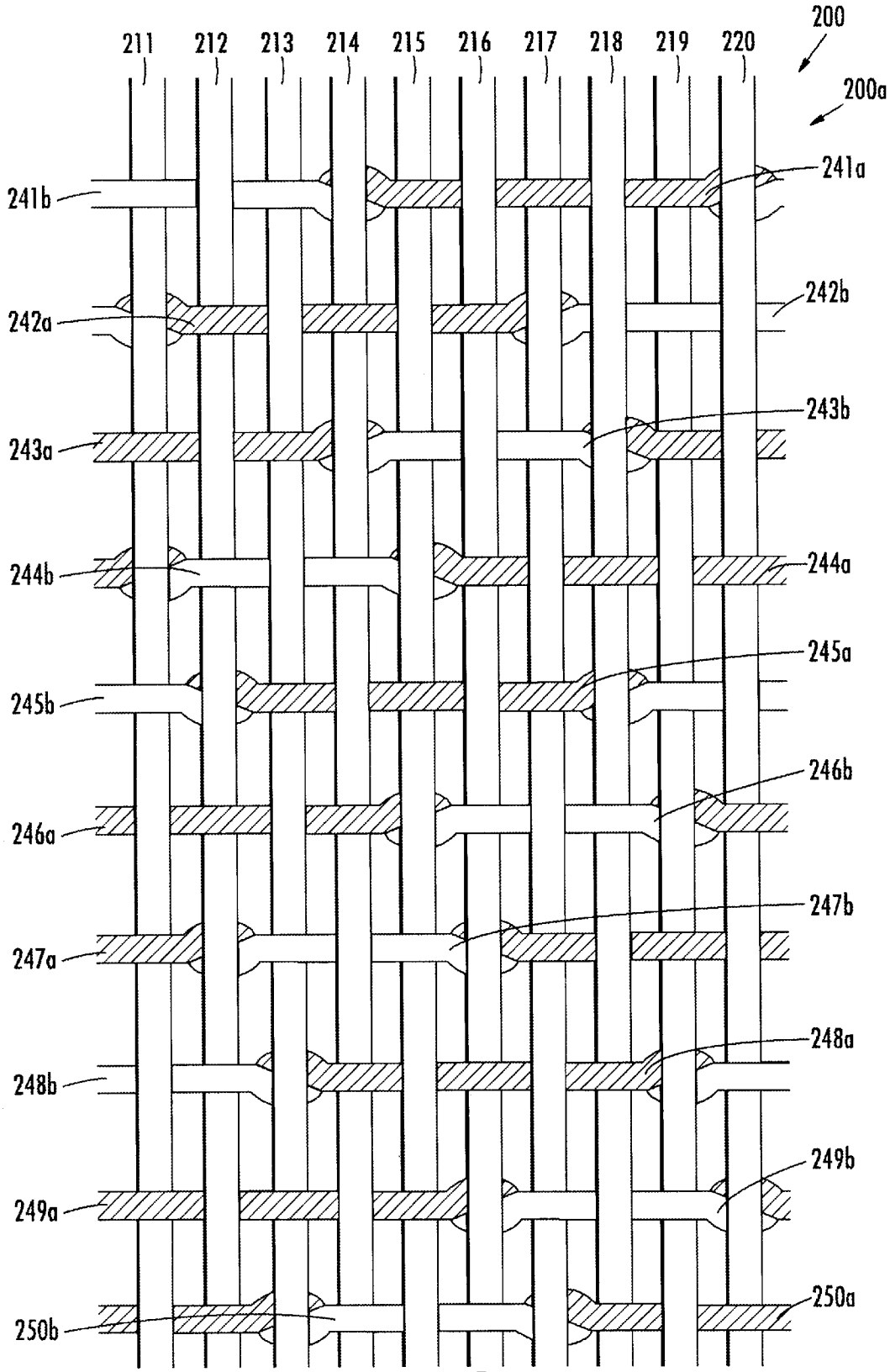
FIG. 5 is a top view of another embodiment of a papermaker's fabric of the present invention.
Figure 6:
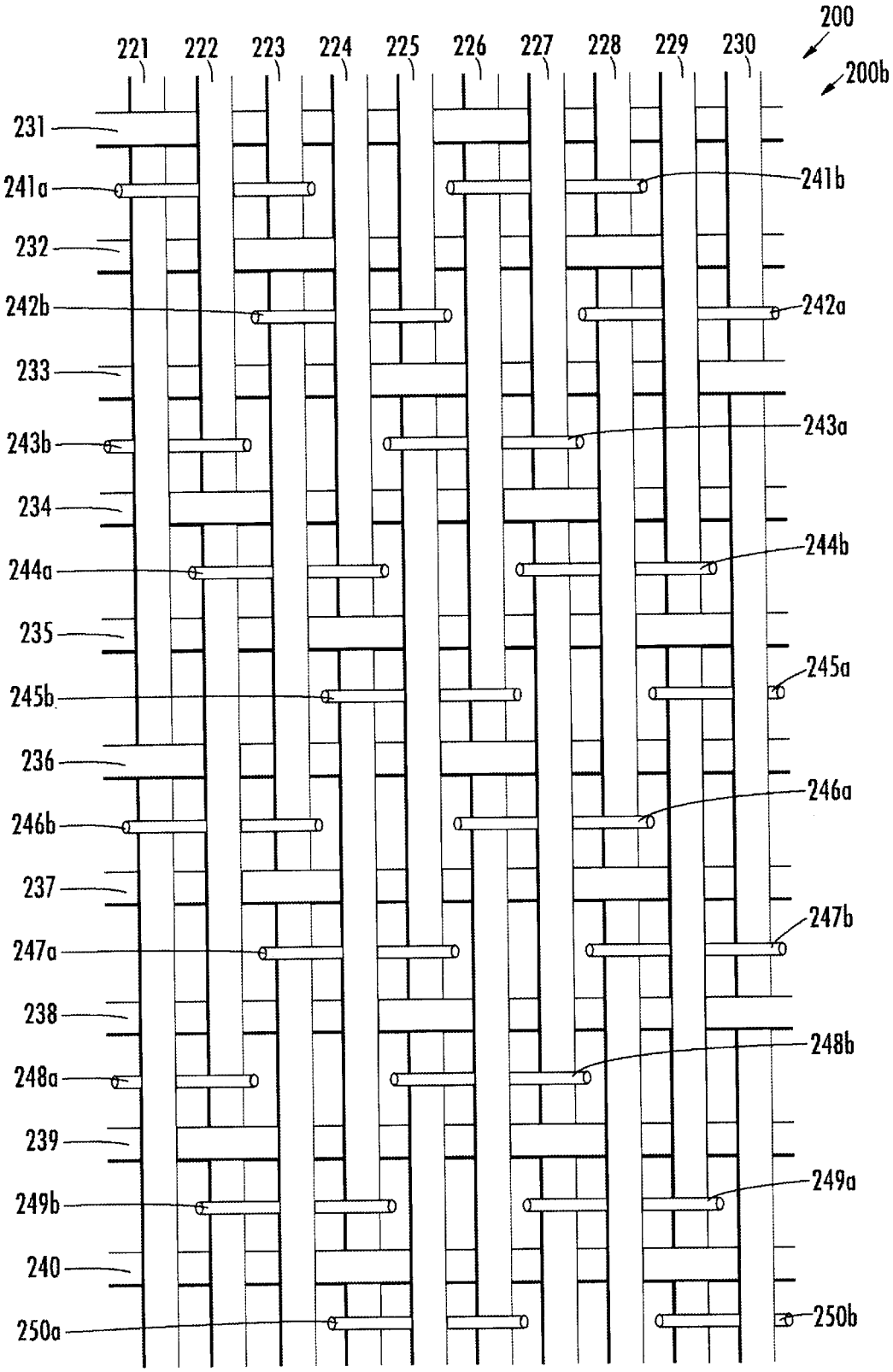
FIG. 6 is a top section view of the bottom layer of the fabric of FIG. 5.

Another embodiment of the present invention, a 20 harness multi-layer forming fabric generally designated at 200, is illustrated in FIGS. 5 and 6, in which a single repeat unit of the fabric is shown. The repeat unit of the fabric 200 includes ten top MD yarns 211–220, ten bottom MD yarns 221–230, ten bottom CMD yarns 231–240, and stitching yarn pairs 241*a*, 241*b* through 250*a*, 250*b*.

Referring first to FIG. 6, a repeat unit of the bottom layer 200*b* of the fabric 200 is shown. The bottom MD yarns 221–230 are interwoven with the bottom CMD yarns 231–240 in a twill pattern like that of the fabrics of FIGS. 1–4, with each bottom CMD yarn passing above one bottom MD yarn, below four bottom MD yarns, then repeating this "over 1/under 4" pattern. For example, bottom CMD yarn 231 passes above bottom MD yarn 221, below bottom MD yarns 222–225, above bottom MD yarn 226, and below bottom MD yarns 227 through 230. The other bottom CMD yarns follow the "over 1/under 4" weave pattern, but each is offset from its nearest bottom CMD yarn neighbors by two bottom MD yarns. Consequently, bottom CMD yarn 232 passes below bottom MD yarns 221 and 222, above bottom MD yarn 223, below bottom MD yarn 224 through 227, above bottom MD yarn 228, and below bottom MD yarns 229 and 230. Thus the "knuckle" formed by bottom MD yarn 223 as it passes below bottom CMD yarn 232 is offset from the "knuckle" formed by bottom MD yarn 221 as it passes over bottom CMD yarn 231 by two bottom MD yarns.

Referring now to FIG. 5, the top layer 200*a* of the fabric 200 is formed by the top MD yarns and by fiber support portions of the stitching yarn pairs. As can be seen in FIG. 5, the fiber support portions of the stitching yarns and the top MD yarns combine to form a plain weave top surface. The interweaving of the stitching yarns and the top and bottom MD yarns can be understood by examination of FIG. 5.

As is the case for the fabrics of FIGS. 1–4, each of the stitching yarns of the repeat unit of fabric 200 can be subdivided into two portions: a fiber support portion that interweaves with the top MD yarns, and a binding portion that interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of stitching yarns of each pair designated with an "a" (e.g, 241*a*, 242*a*, 243*a*) interweaves in an alternating fashion with five top MD yarns (alternately passing over three top MD yarns and under two top MD yarns), and the other stitching yarn of the pair (those designated with a "b") passes over two top MD yarns while passing below a top MD yarn positioned between those two MD yarns. In its fiber support portion, each stitching yarn passes over top MD yarns that fiber support portions of stitching yarns of adjacent pairs pass beneath, and passes below top MD yarns that fiber support portions of stitching yarns of adjacent pairs pass over. In this manner, the stitching yarns form a plain weave pattern with the top MD yarns (see FIG. 5).

In its binding portion, each stitching yarn passes below one bottom MD yarn in the repeat unit. Each stitching yarn passes below the bottom MD yarn that is located between two knuckles formed by adjacent bottom MD yarns over the bottom CMD yarns that sandwich the stitching yarn. The combined binding portions of the stitching yarn pairs establish an "over 4/under 1" pattern on the bottom surface of the fabric 10 (see FIG. 6).

The weaving pattern of the stitching yarns is exemplified by the interweaving of stitching yarn 249*a*, 249*b* with top and bottom MD yarns. In its fiber support portion, stitching yarn 249*a* passes over top MD yarns 211, 213 and 215, and below top MD yarns 212 and 214. It then passes below transitional top MD yarn 216 and above bottom MD yarn 226. In its binding portion, stitching yarn 249*a* passes below top MD yarns 217 through 219 while passing above bottom MD yarns 227 and 229 and below bottom MD yarn 228 to stitch the bottom layer of the fabric 200. Stitching yarn 249*a* then passes between top transitional MD yarn 220 and bottom MD yarn 230. Stitching yarn 249*b* is interwoven such that its binding portion is below that of stitching yarn 249*a*; stitching yarn 249*b* passes below top MD yarns 211 through 215 while passing above bottom MD yarns 221, 222, 224, 225 and below bottom MD yarn 223. In its fiber support portion, stitching yarn 249*b* passes above top MD yarn 217, below top MD yarn 218 and above top MD yarn 219, and below transitional top MD yarn 220 to continue the alternating weave established by stitching yarn 249*a*.

As can be seen in FIGS. 5 and 6, the same pattern described hereinabove for the stitching yarns 249*a*, 249*b* relative to each other is followed by the other stitching yarn pairs, with adjacent pairs of stitching yarns being offset by three MD yarns. For example, stitching yarn 241*a* passes above top MD yarns 215, 217 and 219 and below bottom MD yarn 232. Stitching yarn 242*a* passes above top MD yarns 212, 214 and 216 and below bottom MD yarn 239. Thus, stitching yarn 242*a* is offset from stitching yarn 243*a* by three top and bottom MD yarns. This same three MD yarn offset is followed for the interweaving of the other stitching yarns.

It can also be seen in FIGS. 5 and 6 that the stitching yarn pairs are interwoven with the top and bottom MD yarns such that each "a" yarn (the stitching yarn that passes over three top MD yarns) is positioned between two "b" yarns (stitching yarns that pass over two top MD yarns), and each "b" yarn is positioned between two "a" yarns. This arrangement is demonstrated by examination of stitching yarn pairs 241*a*, 241*b*, 242*a*, 242*b*. As shown in FIGS. 5 and 6, stitching yarn 241*b* is positioned between stitching yarns 241*a* and 242*a*, and stitching yarn 242*a* is positioned between stitching yarns 241*b* and 242*b*. Performance advantages of such a configuration are described in detail in U.S. Pat. No. 5,881,764 to Ward, the disclosure of which is hereby incorporated herein in its entirety.

Those skilled in this art will also appreciate that other plain weave patterns in which the stitching yarns are divided differently into fiber support portions and binding portions can be constructed. For example, the fabric can include a top layer in which each stitching yarn of a pair passes over two, three, four or even more top MD yarns in its fiber support portion. The stitching yarns can pass over different numbers of top MD yarns, or can pass over the same number. Of course, appropriate adjustment of the positioning of the bottom knuckles in the binding portions of such stitching yarns should be made with changes to the stitching yarn pattern on the top surface.

Exemplary yarn sizes for the fabric 200 are set forth in Table 4.

TABLE 4

| Yarn | Diameter (mm) |
|---|---|
| Top MD | 0.13 |
| Top CMD | None |
| Stitching Yarn | 0.13 |
| Bottom MD | 0.17 |
| Bottom CMD | 0.18 |

Figure 7:
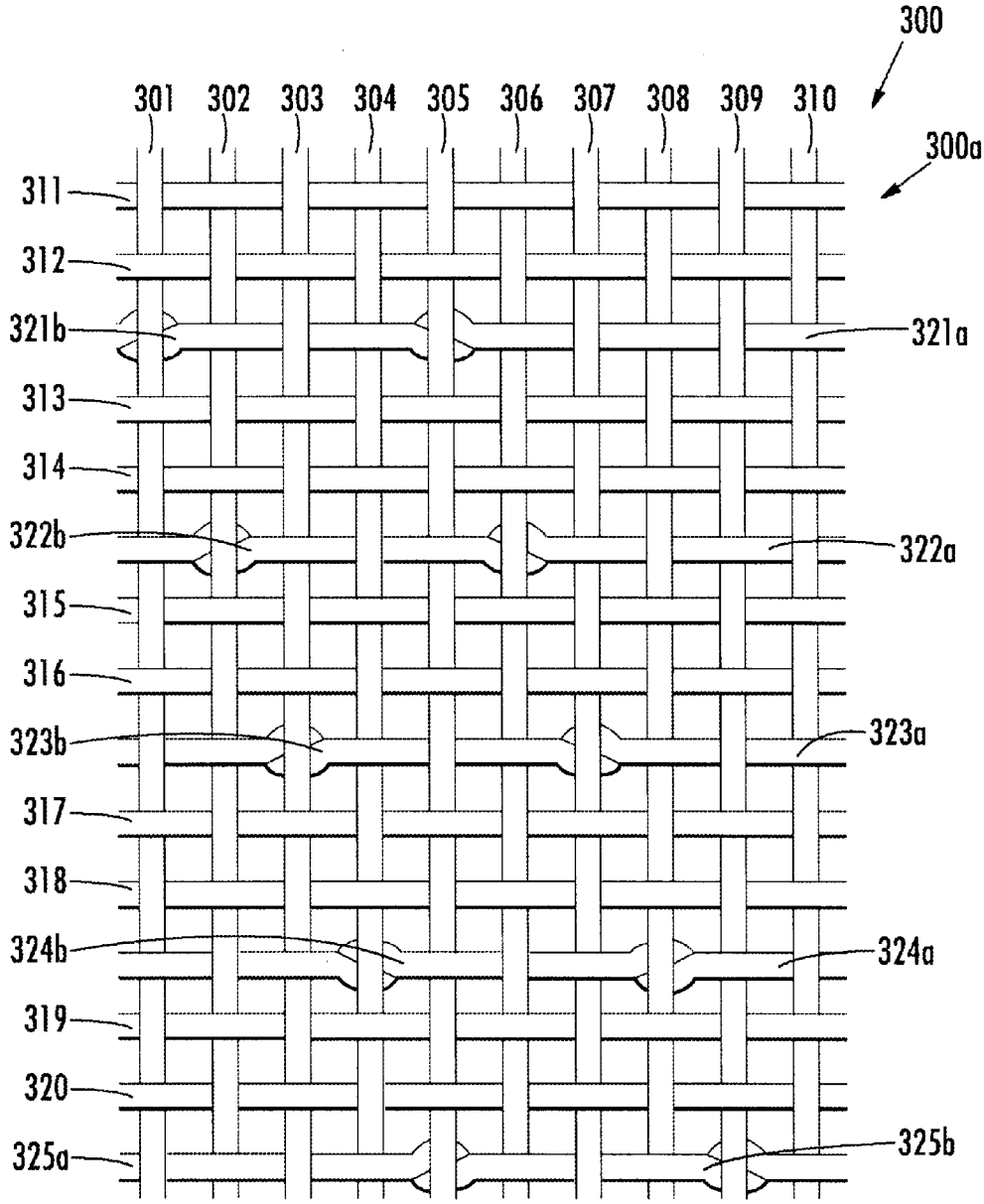
FIG. 7 is a top view of another embodiment of a triple layer papermaker's forming fabric of the present invention.
Figure 8:
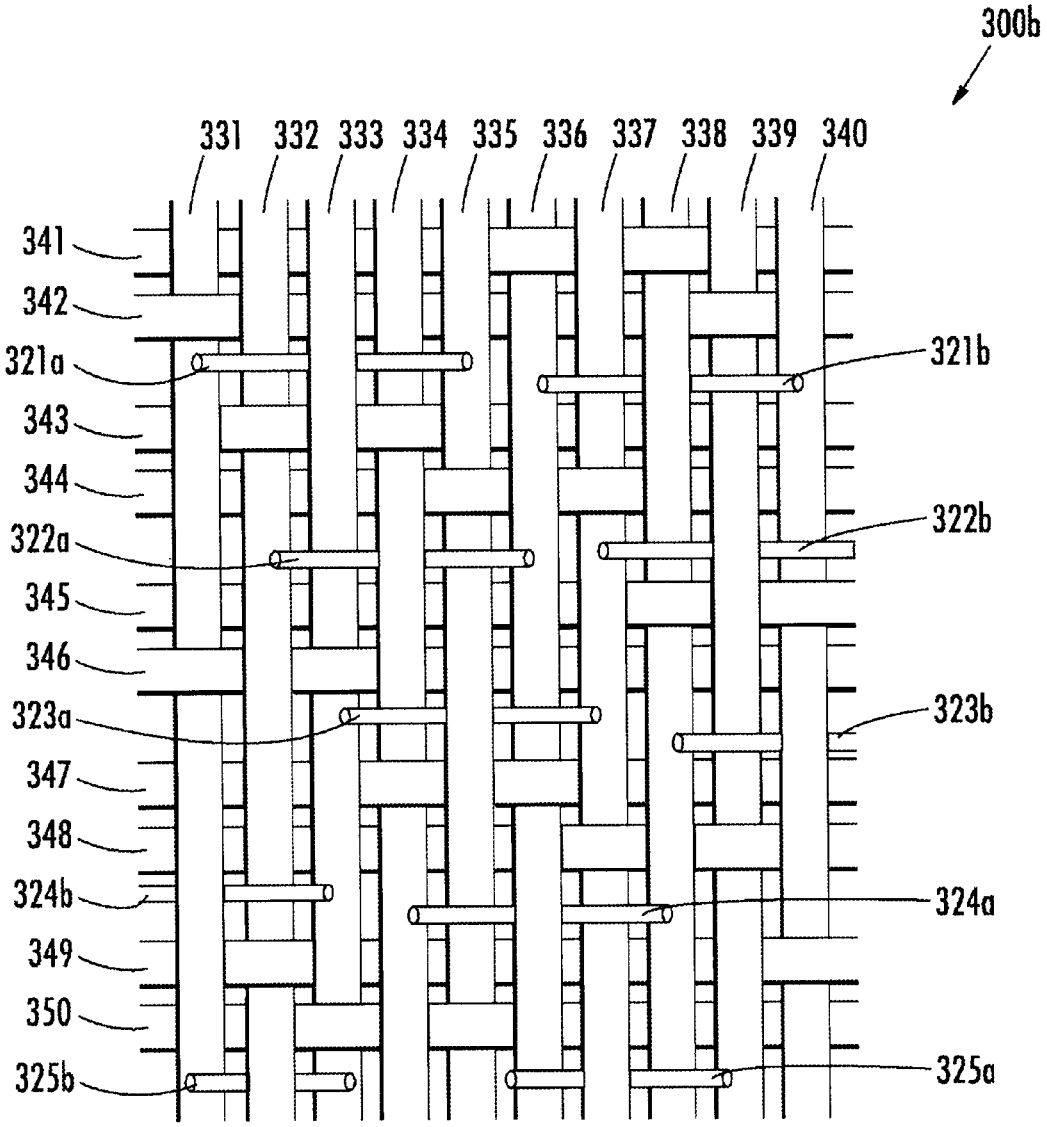
FIG. 8 is a top section view of the bottom layer of the fabric of FIG. 7.

Referring now to FIGS. 7 and 8, another embodiment of a triple layer fabric, designated broadly at 300, is illustrated therein. The triple layer fabric 300 includes a top layer 300*a* and a bottom layer 300*b*. The top layer 300*a* includes ten top MD yarns 301–310 interwoven with ten top CMD yarns 311–320, as well as five pairs of stitching yarns 321*a*, 321*b*–325*a*, 325*b*. The top CMD yarns and stitching yarns are arranged such that a pair of stitching yarn follows every two top CMD yarns in a repeating pattern; for example, the top layer 300*a* sequentially includes top CMD yarn 311, top CMD yarn 312, stitching yarn pair 321*a*, 321*b*, top CMD yarn 313, top CMD yarn 314, stitching yarn pair 322*a*, 322*b*, and so on. The top CMD yarns and fiber support portions of the stitching yarns are interwoven with the top MD yarns to form a plain weave surface in much the same manner as that of the fabric 20 described above and illustrated in FIG. 1, although with stitching yarn pairs replacing only every third top CMD yarn.

Referring now to FIG. 8, the bottom layer 300*b* includes ten bottom MD yarns 331–340 interwoven with ten bottom CMD yarns 341–350. The weaving pattern of the bottom MD yarns relative to the bottom CMD yarns is such that each bottom CMD yarn follows an "over 1/under 1/over 1/under 7" pattern relative to the bottom MD yarns. For example, bottom CMD yarn 346 passes above bottom MD yarn 331, below bottom MD yarn 332, above bottom MD yarn 333, and below bottom MD yarns 334–340. Adjacent bottom CMD yarns are offset from one another by three bottom MD yarns; thus, bottom CMD yarn 347, which is adjacent to bottom CMD yarn 346, passes above bottom MD yarns 334 and 336, each of which is three bottom CMD yarns away from the bottom MD yarns 331, 334 passed over by bottom CMD yarn 346. This pattern, in which a bottom CMD yarn forms a bottom side knuckle between two bottom side knuckles formed by bottom MD yarns, has performance advantages described in co-assigned and co-pending U.S. patent application Ser. No. 09/579,549 (filed May 26, 2000), the disclosure of which is hereby incorporated herein by reference in its entirety.

When the bottom layer 300*b* is joined with the top layer 300*a*, each of the bottom CMD yarns is positioned substantially directly below a corresponding top CMD yarn. There is no bottom CMD yarn positioned substantially directly below the stitching yarn pairs, thereby providing a space in which the stitching yarns can stitch below a bottom CMD yarn.

Exemplary yarn sizes for the fabric 300 are set forth in Table 5.

TABLE 5

| Yarn | Diameter (mm) |
|---|---|
| Top MD | 0.13 |
| Top CMD | 0.13 |
| Stitching Yarn | 0.11 |
| Bottom MD | 0.17 |
| Bottom CMD | 0.25 |

Figure 9:
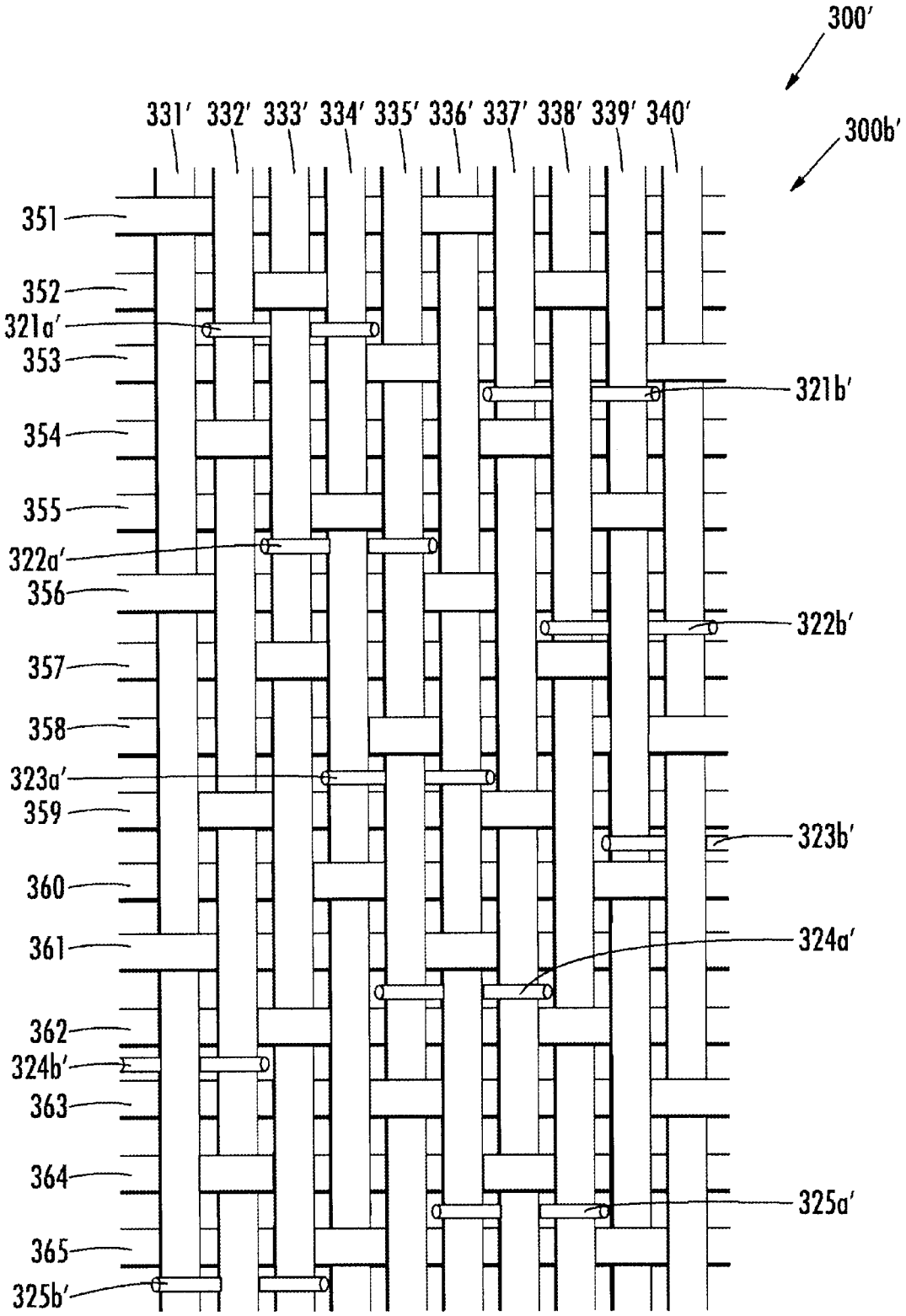
FIG. 9 is a top section view of another embodiment of a triple layer papermakers' forming fabric of the present invention showing the configuration of the bottom layer of the fabric.

A further twenty harness fabric embodiment of the present invention, designated broadly at 300', is illustrated in FIG. 9. The top layer of the fabric 300' is identical to the top layer of the fabric 300 illustrated in FIG. 7. The bottom layer 300*b*' of the fabric 300', much like that of the fabric 20' illustrated in FIG. 3, includes bottom CMD yarns below the stitching yarns, such that, in a repeat unit, ten bottom MD yarns 331'–340' interweave with fifteen bottom CMD yarns 351–365 in a 1×4 twill pattern. Stitching yarns 321*a*, 321*b*–325*a*, 325*b* are interwoven into the top layer in the manner described above for fabric 300. In the bottom layer 300*b*', the stitching yarns interweave with one bottom MD yarn, but pass on opposite sides of the bottom CMD yarn located below the pair (this relationship is as described above for the fabric 20' illustrated in FIG. 3). As an example, the stitching yarn 321*a*' passes below bottom MD yarn 338' while passing on the side of bottom CMD yarn 343 nearer to bottom CMD yarn 342, and the stitching yarn 321*b*' passes below bottom MD yarn 333' nearer to bottom CMD yarn 344.

Exemplary yarn sizes for the fabric 300' are set forth in Table 6.

TABLE 6

| Yarn | Diameter (mm) |
|---|---|
| Top MD | 0.13 |
| Top CMD | 0.13 |
| Stitching Yarn | 0.11 |
| Bottom MD | 0.17 |
| Bottom CMD | 0.20 |

Figure 10:
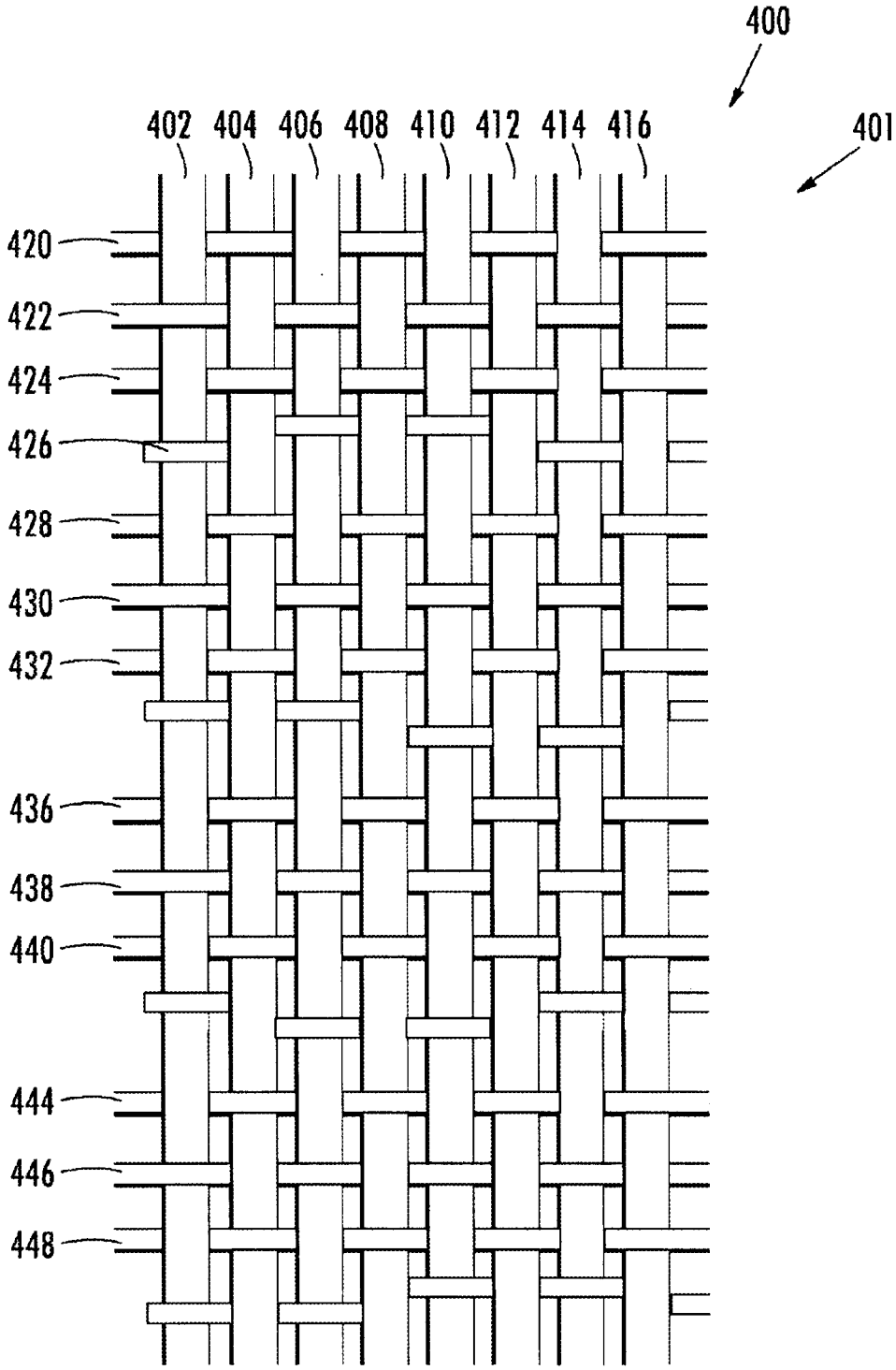
FIG. 10 is a top view of another embodiment of a triple layer papermaker's forming fabric of the present invention.
Figure 11:
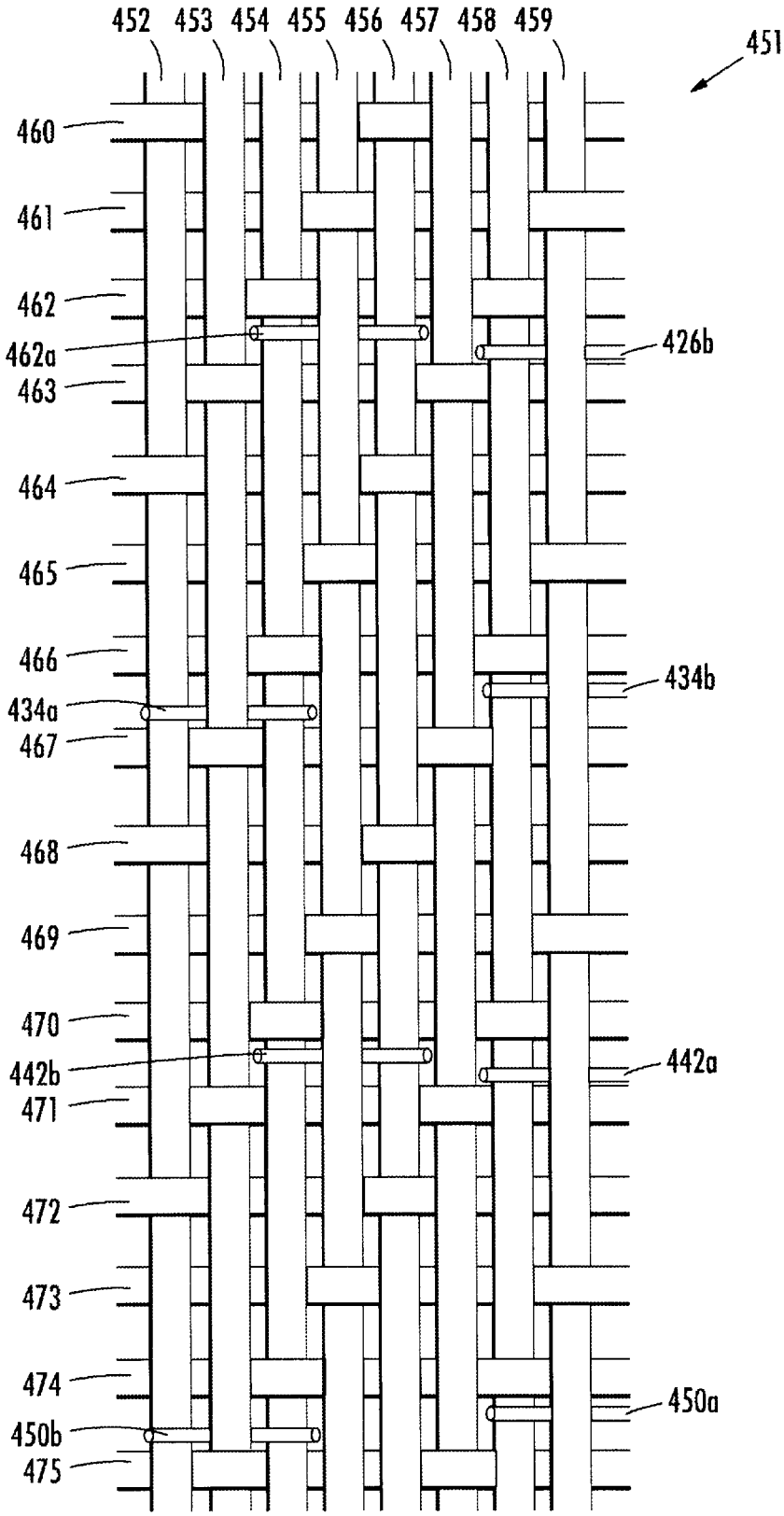
FIG. 11 is a top section view of the bottom layer of the fabric of FIG. 10.

Another embodiment of the present invention, a sixteen harness triple layer fabric designated broadly at 400, is illustrated in FIGS. 10 and 11. The fabric 400 includes a top fabric layer 401 and a bottom fabric layer 451. The top fabric layer 401 includes eight top MD yarns 402–416 interwoven with twelve top CMD yarns 420–448 and four pairs of stitching yarns 426*a*,426*b*–450*a*,450*b*. The top MD yarns and top CMD yarns are interwoven in a plain weave pattern, with the stitching yarns positioned between sets of three adjacent top CMD yarns and also interweaving with the top MD yarns in a plain weave pattern. The manner in which a plain weave surface is formed on the top layer via a combination of top MD yarns, top CMD yarns and stitching yarns is described above and in U.S. Pat. No. 4,501,113 to Osterberg and U.S. Pat. No. 5,967,195 to Ward, the disclosures of each of which are hereby incorporated by reference in their entireties.

The bottom fabric layer 451 (FIG. 10) comprises eight bottom MD yarns 452–459 that are interwoven with sixteen bottom CMD yarns 460–475. The weaving pattern of the bottom fabric layer 451 is such that each bottom MD yarn passes above three adjacent bottom CMD yarns, below a bottom CMD yarn, above three adjacent bottom CMD yarns, and below another bottom CMD yarn. Adjacent bottom MD yarns are offset from one another by three bottom CMD yarns. For example, bottom MD yarn 452 passes below bottom CMD yarns 460, 464, 468 and 472, while adjacent bottom MD yarns 453 passes below bottom CMD yarns 463, 467, 471 and 475.

It should be noted that each stitching yarn of each stitching yarn pair passes below one bottom MD yarn as part of the repeat unit. For example, stitching yarns 426*a*, 426*b* pass below, respectively, bottom MD yarns 455, 459. The next stitching yarn pair passes below a bottom MD yarn that is offset by two bottom MD yarns, so, for example, stitching yarns 434*a*, 434*b* pass below, respectively, bottom MD yarns 453, 457. It should also be noted that, in the illustrated and preferred configuration, there are the same number of top CMD yarns (assuming that each stitching yarn pair serves as one top CMD yarn for the purposes of this calculation) as bottom CMD yarns, and that each bottom CMD yarn is positioned below a corresponding top CMD yarn or stitching yarn pair. As a result, when a yarn of a stitching yarn pair interweaves with a bottom MD yarn, it must occupy space between two adjacent bottom CMD yarns. For example, stitching yarns 426*a*, 426*b* are positioned above bottom CMD yarn 463, but when these stitching yarns interweave with, respectively, bottom MD yarns 408 and 416, they occupy the space between bottom CMD yarns 462 and 463. Alternatively, the bottom layer 451 can omit every fourth bottom CMD yarn such that no bottom CMD yarn is present below the stitching yarns, with the result that the stitching yarns occupy the space left by the omitted bottom CMD yarns.

Exemplary yarn sizes for the fabric 400 are set forth in Table 7.

TABLE 7

| Yarn | Diameter (mm) |
|---|---|
| Top MD | 0.13 |
| Top CMD | 0.13 |
| Stitching Yarn | 0.11 |
| Bottom MD | 0.17 |
| Bottom CMD | 0.18 |

The embodiments described above are illustrative of triple layer forming fabrics that may be encompassed by the present invention. Those skilled in this art will appreciate that triple layer fabrics of the present invention may also be woven in different configurations than those illustrated herein. For example, the fabrics of the present invention may contain different numbers of yarns in a repeat unit. The illustrated embodiments are woven on either 20 harnesses (the embodiments of FIGS. 1 to 9) or 16 harnesses (the embodiment of FIGS. 10 and 11). Of course, the concepts underlying the illustrated weave patterns can also be embodied in other triple layer fabrics that are woven on, for example, 18, 28 or 30 harnesses.

In addition, triple layer fabrics of the present invention may take different weave patterns than those illustrated herein. For instance, the bottom layer of the fabric can have a different configuration than that shown. As an example, a triple layer fabric may be woven on 24 harnesses, wherein the bottom fabric layer includes 12 bottom MD yarns and twelve bottom CMD yarns. In such a fabric, each bottom CMD yarn may, by way of example, follow an "over 6/under 1/over 4/under 1" pattern relative to the bottom CMD yarns, and adjacent MD yarns may be offset from one another by five CMD yarns. An exemplary bottom layer such as this is illustrated and described in U.S. Pat. No. 5,967,195 to Ward noted above. As another example of a triple layer fabric having a differing repeat pattern for the bottom layer, a triple layer fabric may be woven on 20 harnesses, wherein the bottom fabric layer includes ten bottom MD yarns and ten bottom CMD yarns, with each bottom CMD yarn following an "over 5/under 1/over 3/under 1" pattern relative to the bottom CMD yarns, and with adjacent MD yarns being offset from one another by four CMD yarns. The skilled artisan will understand that there are numerous other bottom layer configurations that may be suitable for use with the triple layer fabrics of the invention, including those illustrated in the aforementioned co-assigned and co-pending U.S. patent application Ser. No. 09/579,549.

Further, the triple layer fabrics of the present invention may also include top layer configurations that differ from those illustrated. For example, a 24 harness fabric that utilizes in its top surface twelve top MD yarns, six top CMD yarns, and six stitching yarn pairs may be used. One example of such a fabric is illustrated in U.S. Pat. No. 5,967,195 to Ward noted above. Other examples should be apparent to the skilled artisan. It is preferred that the top surface employ stitching yarns that "complete the weave" of the top surface of the fabric, such that the top CMD yarns and the fiber support portions of the stitching yarn pairs follow a similar weave pattern to form an integrated papermaking surface, and it is more preferred that the top surface of the fabric employ stitching yarns and top CMD yarns that form a plain weave papermaking surface.

Moreover, those skilled in this art will appreciate that the fabrics of the present invention may have differing numbers of top and bottom CMD yarns in a repeat unit; for example, there may be 1.5, two or three times as many top CMD yarns as bottom CMD yarns, or, as in the fabrics illustrated in FIGS. 3 and 9, there may be equal numbers of top and bottom CMD yarns (assuming that a stitching yarn pair is considered as one top CMD yarn). In the embodiments in which there are equal numbers top and bottom CMD yarns, such that the stitching yarn pairs are positioned above a bottom CMD yarn, it is preferred that the stitching yarns of a pair stitch on opposite sides of the underlying bottom CMD yarn.

The form of the yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, aramid, nylon, or the like. The skilled artisan should select a yarn material according to the particular application of the final fabric. In particular, round monofilament yarns formed of polyester or nylon are preferred.

The foregoing embodiments are illustrative of the present invention, and are not to be construed as limiting thereof. The invention is defined by the following claims, with equivalents of the claims to be included therein.

That which is claimed is:

1. A triple layer papermaker's fabric, comprising:

a set of top machine direction yarns;

a set of top cross machine direction yarns interwoven with said top machine direction yarns to form a top fabric layer;

a set of bottom machine direction yarns;

a set of bottom cross machine direction yarns interwoven with said bottom machine direction yarns to form a bottom fabric layer;

a plurality of stitching yarns interwoven with said top and bottom fabric layers;

wherein a pair of first and second stitching yarns is positioned between adjacent pairs of top cross machine direction yarns, said first and second stitching yarns of each pair being interwoven with said top and bottom machine direction yarns such that, as a fiber support portion of said first stitching yarn is interweaving with said top machine direction yarns, a binding portion of said second stitching yarn is positioned below said top machine direction yarns, and such that as a fiber support portion of said second stitching yarn is interweaving with said top machine direction yarns, a binding portion of said first stitching yarn is positioned below said top machine direction yarns, and such that said first and second stitching yarns cross each other as they pass below a transitional top machine direction yarn, and such that each of said binding portions of said first and second stitching yarns passes below at least one of said bottom machine direction yarns;

wherein said top machine direction yarns, said top cross machine direction yarns, and said fiber support portions of said stitching yarns interweave to form a plain weave surface; and wherein said top machine direction yarns have a first diameter, said bottom machine direction yarns have a second diameter, and said top cross machine direction yarns have a third diameter, and a ratio of said first diameter and said second diameter is between about 0.75 and 0.95, and a ratio between said first diameter and said third diameter is between about 0.8 and 1.1.

2. The triple layer fabric defined in claim 1, wherein said fiber support portions of said first stitching yarns pass over a first number of said top machine direction yarns, said fiber support portions of said second stitching yarns pass over a second number of said machine direction yarns, and said first number differs from said second number.

3. The triple layer fabric defined in claim 1, wherein said pairs of bottom machine direction yarns forming bottom machine direction knuckles under a common bottom cross machine direction yarn are separated from one another by one bottom machine direction yarn.

4. The triple layer fabric defined in claim 1, wherein said bottom machine direction yarns and bottom cross machine direction yarns are interwoven in a twill pattern.

5. The triple layer fabric defined in claim 1, wherein one of said stitching yarn pairs is positioned between each adjacent pair of top cross machine direction yarns.

6. The triple layer fabric defined in claim 1, wherein said repeat unit comprises equal numbers of top cross machine direction yarns and bottom cross machine direction yarns.

7. The triple layer fabric defined in claim 1, wherein said repeat unit comprises equal numbers of (a) top cross machine direction yarns and stitching yarn pairs and (b) bottom cross machine direction yarns.

8. The triple layer fabric defined in claim 7, wherein each of said stitching yarn pairs is positioned above a bottom cross machine direction yarn.

9. The triple layer fabric defined in claim 8, wherein a first stitching yarn of each pair interweaves with a bottom machine direction yarn on one side of the bottom cross machine direction yarn that the first stitching yarn is positioned above, and a second stitching yarn of that pair interweaves with a bottom cross machine direction yarn on an opposite side of the bottom machine direction yarn that the second stitching yarn is positioned above.

10. The triple layer fabric defined in claim 1, wherein said fabric has a void volume of between about 34 $mm^3/cm^2$ and 42 $mm^3/cm^2$.

11. The triple layer fabric defined in claim 1, wherein said fabric has a fiber support index of between about 150 and 200.

12. The triple layer fabric defined in claim 1, wherein said fabric has a caliper of between about 0.60 mm and 0.75.

13. The triple layer fabric defined in claim 1, wherein said repeat unit includes between 8 and 12 top machine direction yarns and between 8 and 12 bottom machine direction yarns.

14. A triple layer papermaker's fabric, comprising:

a set of top machine direction yarns;

a set of top cross machine direction yarns interwoven with said top machine direction yarns to form a top fabric layer;

a set of bottom machine direction yarns;

a set of bottom cross machine direction yarns interwoven with said bottom machine direction yarns to form a bottom fabric layer;

a plurality of stitching yarns interwoven with said top and bottom fabric layers;

wherein a pair of first and second stitching yarns is positioned between adjacent pairs of top cross machine direction yarns, said first and second stitching yarns of each pair being interwoven with said top and bottom machine direction yarns such that, as a fiber support portion of said first stitching yarn is interweaving with said top machine direction yarns, a binding portion of said second stitching yarn is positioned below said top machine direction yarns, and such that as a fiber support portion of said second stitching yarn is interweaving with said top machine direction yarns, a binding portion of said first stitching yarn is positioned below said top machine direction yarns, and such that said first and second stitching yarns cross each other as they pass below a transitional top machine direction yarn, and such that each of said binding portions of said first and second stitching yarns passes below at least one of said bottom machine direction yarns;

wherein said top machine direction yarns, said top cross machine direction yarns, and said fiber support portions of said stitching yarns interweave to form a plain weave surface;

wherein said top machine direction yarns have a first diameter, said bottom machine direction yarns have a second diameter, and said top cross machine direction yarns have a third diameter, and a ratio of said first diameter and said second diameter is between about 0.75 and 0.95, and a ratio between said first diameter and said third diameter is between about 0.8 and 1.1; and wherein said fabric has a void volume of between about 34 $mm^3/cm^2$ and 42 $mm^3/cm^2$, a fiber support index of between about 150 and 200, and a caliper of between about 0.60 mm and 0.75 mm.

15. The triple layer fabric defined in claim 14, wherein said fiber support portions of said first stitching yarns pass over a first number of said top machine direction yarns, said fiber support portions of said second stitching yarns pass over a second number of said machine direction yarns, and said first number differs from said second number.

16. The triple layer fabric defined in claim 14, wherein said pairs of bottom machine direction yarns forming bottom machine direction knuckles under a common bottom cross machine direction yarn are separated from one another by one bottom machine direction yarn.

17. The triple layer fabric defined in claim 14, wherein said bottom machine direction yarns and bottom cross machine direction yarns are interwoven in a twill pattern.

18. The triple layer fabric defined in claim 14, wherein one of said stitching yarn pairs is positioned between each adjacent pair of top cross machine direction yarns.

19. The triple layer fabric defined in claim 14, wherein said repeat unit comprises equal numbers of top cross machine direction yarns and bottom cross machine direction yarns.

20. The triple layer fabric defined in claim 14, wherein said repeat unit comprises equal numbers of (a) top cross machine direction yarns and stitching yarn pairs and (b) bottom cross machine direction yarns.

21. The triple layer fabric defined in claim 20, wherein each of said stitching yarn pairs is positioned above a bottom cross machine direction yarn.

22. The triple layer fabric defined in claim 21, wherein a first stitching yarn of each pair interweaves with a bottom machine direction yarn on one side of the bottom cross machine direction yarn that the first stitching yarn is positioned above, and a second stitching yarn of that pair interweaves with a bottom cross machine direction yarn on an opposite side of the bottom machine direction yarn that the second stitching yarn is positioned above.

23. A triple layer papermaker's fabric, comprising:

a set of top machine direction yarns;

a set of top cross machine direction yarns interwoven with said top machine direction yarns to form a top fabric layer;

a set of bottom machine direction yarns;

a set of bottom cross machine direction yarns interwoven with said bottom machine direction yarns to form a bottom fabric layer;

a plurality of stitching yarns interwoven with said top and bottom fabric layers;

wherein a pair of first and second stitching yarns is positioned between adjacent pairs of top cross machine direction yarns, said first and second stitching yarns of each pair being interwoven with said top and bottom machine direction yarns such that, as a fiber support portion of said first stitching yarn is interweaving with said top machine direction yarns, a binding portion of said second stitching yarn is positioned below said top machine direction yarns, and such that as a fiber support portion of said second stitching yarn is interweaving with said top machine direction yarns, a binding portion of said first stitching yarn is positioned below said top machine direction yarns, and such that said first and second stitching yarns cross each other as they pass below a transitional top machine direction yarn, and such that each of said binding portions of said first and second stitching yarns passes below at least one of said bottom machine direction yarns;

wherein said top machine direction yarns, said top cross machine direction yarns, and said fiber support portions of said stitching yarns interweave to form a plain weave surface; and wherein said top machine direction yarns have a first diameter between about 0.12 and 0.14 mm, said bottom machine direction yarns have a second diameter between about 0.15 and 0.18 mm, and said top cross machine direction yarns have a third diameter between about 0.11 and 0.13 mm.

24. The triple layer fabric defined in claim 23, wherein the ratio between said first diameter and said second diameter is between about 0.75 and 0.95, and the ratio between said first diameter and said second diameter is between about 0.8 and 1.1.

25. The triple layer fabric defined in claim 24, wherein said fabric has a void volume of between about 34 $mm^3/cm^2$ and 42 $mm^3/cm^2$, a fiber support index of between about 150 and 200, and a caliper of between about 0.60 mm and 0.75 mm.

* * * * *